United States Patent [19]

Ohigashi

[11] Patent Number: 4,594,283

[45] Date of Patent: Jun. 10, 1986

[54] SHOEMAKING MATERIAL AND PRODUCTION THEREOF

[75] Inventor: Toshihide Ohigashi, Nara, Japan

[73] Assignee: Kuraray Co., Ltd., Kurashiki, Japan

[21] Appl. No.: 713,899

[22] Filed: Mar. 20, 1985

[30] Foreign Application Priority Data

Apr. 5, 1984 [JP] Japan ..... 59-68585

[51] Int. Cl.[4] ..... B32B 7/02

[52] U.S. Cl. ..... 428/218; 156/296; 156/297; 156/308.2; 428/219; 428/234; 428/246; 428/253; 428/284; 428/298; 428/300; 428/296

[58] Field of Search ..... 428/212, 218, 246, 253, 428/284, 297, 298, 299, 300, 219, 234, 296; 156/380.9, 499, 555, 308.2, 296, 297

[56] References Cited

U.S. PATENT DOCUMENTS 4,373,000 2/1983 Knoke et al. ..... 428/284
4,377,615 3/1983 Suzuki et al. ..... 428/218
4,542,060 9/1985 Yoshida et al. ..... 428/299

FOREIGN PATENT DOCUMENTS 3247343 6/1984 Fed. Rep. of Germany ..... 428/218

*Primary Examiner*—James J. Bell
*Attorney, Agent, or Firm*—Oblon, Fisher, Spivak, McClelland & Maier

[57] ABSTRACT

There is provided a shoemaking material which comprises a laminate of two webs having different apparent densities. One web has an apparent density lower than 0.4 g/cm$^3$, and the other web has an apparent density higher than 0.3 g/cm$^3$, with their difference being greater than 0.1 g/cm$^3$, preferably greater than 0.3 g/cm$^3$. The laminate has a weight of 200 to 1500 g/m$^2$. The shoemaking material of such structure has a soft face layer which provides cushioning properties and a hard core layer which keeps the shape of a shoe. Because of this unique structure, it permits moisture to pass through and dry rapidly. Thus it keeps shoes in good sanitary condition and makes shoes more functional.

8 Claims, No Drawings

SHOEMAKING MATERIAL AND PRODUCTION THEREOF

BACKGROUND OF THE INVENTION

1. Field of the Invention

The present invention relates to a shoemaking material and a process for producing the same. The shoemaking material of this invention will be used mainly for the inside of a shoe such as counter, cup insole, and injection insole.

2. Description of the Prior Art

A conventional shoe is made up of at least 20 parts, including the outer leather and shaping material. The latter is usually thermosetting resin-impregnated paper or thermoplastic resin sheet backed with a foamed polyurethane sheet or non-woven fabric. This backing is intended to impart resilience to the shaping material. The conventional shoemaking material has many disadvantages. In the case of counter, for example, it is necessary to sew a molded plate onto the outer leather. The molded plate is difficult to handle and does not return to its original form after deformation. In the case of cup insole, it is necessary to attach a resilient material to a molded plate. Thus the conventional shoemaking process will be greatly simplified if it is possible to produce in a single step a molded plate made up of a hard core and a soft resilient face. This technique will also be useful to improve and simplify the process for making children's shoes which are currently formed by backing the outer leather with a resilient material like felt by sewing or bonding.

On the other hand, the resilient part of the conventional insole is foamed polyurethane sheet or felt. The former is undesirable because it absorbs no sweat and gets musty, and the latter is also undesirable because it absorbs sweat and remains wet with it. Thus there is a demand for a new material for insole which absorbs sweat to keep dry the inside of a shoe and yet dries as soon as it is undone. So far, there has been no material which meets both of this requirement and the above-mentioned moldability.

SUMMARY OF THE INVENTION

Accordingly, it is an object of this invention to provide a shoemaking material which comprises a laminate of two webs having different apparent densities. One web has an apparent density lower than 0.4 g/cm$^3$, and the other web has an apparent density higher than 0.3 g/cm$^3$, with their difference being greater than 0.1 g/cm$^3$, preferably greater than 0.3 g/cm$^3$. The laminate has a weight of 200 to 1500 g/m$^2$. The shoemaking material of such structure has a soft face layer which provides cushioning properties and a hard core layer which keeps the shape of a shoe. Because of this unique structure, it permits moisture to pass through and dries rapidly. Thus it keeps shoes in good sanitary conditions and makes shoes more functional. Moreover, it is durable.

DETAILED DESCRIPTION OF THE INVENTION

The shoemaking material of this invention has the following features. It can be readily thermoformed at a comparatively low temperature. Before being incorporated into a shoe, it is attached in the flat form to the outer leather by sewing, and the composite material is thermoformed into a shoe by a hot press without any deterioration of the outer leather by heat. The single step of thermoforming provides a molded item made up of a shape-keeping core and a resilient cushioning face layer. No steps are required to bond two kinds of materials together.

These features are derived from the laminate of two webs which are specified below. Each web is made up of main fibers and binder fibers which bond main fibers with one another to form a network structure. The two webs are different in apparent density. One web forming the face layer has an apparent density lower than 0.4 g/cm$^3$, and the other web forming the core layer has an apparent density higher than 0.3 g/cm$^3$, with the difference being greater than 0.1 g/cm$^3$, preferably greater than 0.3 g/cm$^3$. In the most suitable embodiment, the core web has an apparent density of 0.9 to 1.3 g/cm$^3$, so that it is capable of deep drawing. The laminate of such structure has a weight of 200 to 1500 g/m$^2$. The shoemaking material of this invention having the above-mentioned structure obviates the steps of attaching a foamed sheet or feltlike material to the outer leather to impart resilience. Therefore, the present invention leads to a reduction of steps as well as energy saving.

The apparent density of the web and the weight of the laminate are specified as above so that the shoemaking material of this invention can be made into insoles which are superior in hygiene, durability, and cushioning action. On account of its unique breathable structure, the insole made of the shoemaking material of this invention absorbs sweat through the face layer and retains the absorbed sweat in the core layer, thereby keeping dry the face of the insole, while the shoes are on the feet. The breathable structure and the hydrophobic nature of the constituting material permit the absorbed sweat to transpire while the shoes are off the feet. It will take about 10 minutes for the insole to dry. In addition, the insole has a heat-insulating effect, causing the feet to feel cool in summer and warm in winter. Another additional features include the soft face layer that absorbs shocks, the hard core layer that increases rebounding, the light weight (30 to 40 g a pair of shoes), the high resistance to tear, deformation, and wear, and the high durability that permits washing and keeps the hardness unchanged.

It is believed that the shoemaking material of this invention is new in that the web is formed by bonding main fibers with binder fibers.

The following is a detailed description of the shoemaking material of this invention. The shoemaking material of this invention is characterized first by its double layered structure and secondly by its weight ranging from 200 to 1500 g/m$^2$. The double layer structure is formed by two webs. One web should have an apparent density lower than 0.4 g/cm$^3$, and the other web should have an apparent density higher than 0.3 g/cm$^3$, with the difference being greater than 0.1 g/cm$^3$. According to the preferred embodiments, the material of double layered structure is formed by heating two or more webs placed on top of the other, so that the main fibers are partly bonded to one another by the binder fibers. However, it is not always necessary to start with two or more webs. The double layered structure may be produced from a single web by properly selecting the heating condition so that the difference in apparent density is created as specified above. What is important in this invention is that the material has the double layered structure formed by two webs, each having an apparent density as specified above.

The difference in apparent density is necessary for the material to have a soft layer and a hard layer. It should be greater than 0.1 g/cm$^3$, and preferably greater than 0.3 g/cm$^3$. Thus the web of the face layer should preferably have an apparent density lower than 0.4 g/cm$^3$, and the web of the core layer should preferably have an apparent density higher than 0.7 g/cm$^3$. In this invention it is permitted to interpose film, resin-impregnated paper, woven or knitted fabric, or a third web between the two webs so long as the above-mentioned requirements are met.

In what follows, we will mention in detail the process for producing the shoemaking material of this invention. The main fibers forming either the web of face layer and the web of core layer may be organic synthetic fibers, regenerated fibers, natural fibers, or inorganic fibers, or a mixture thereof. The main fibers for the web of core layer should preferably be thick ones, 6 to 20 denier (abbreviated as "d" hereinafter), more suitably 10 to 15 d, so that they impart stiffness to the molded item. Most suitably, they should be hollow fibers. The adequate length is 30 to 80 mm. On the other hand, the main fibers for the web of face layer should have a proper fineness to meet specific requirements which differ depending on which part of the shoe the material is used for. Where wear resistance is required, a fineness of 6 to 20 d is adequate, and where flexibility is important, a fineness of 2 to 6 d is adequate. An adequate length is 30 to 80 mm. The main fibers forming the web of face layer are not always necessary to be the same as those forming the web of core layer. The main fibers may preferably be treated for soilproofing, antistatic effect, flame resistance, and antibacterial finish. Such treatment may be carried out before or after the fibers are formed into the web.

The binder fibers in the web are required to soften or melt at a temperature below the melting point of the main fibers. They are made of a thermoplastic resin such as polyolefin, polyamide, and polyester. They may be uniform in structure so that they soften or melt entirely when heated. They may also be composite fibers made of two components, one melting and the other not melting during heat treatment. They may be of sheath-and-core type, side-by-side type, or matrix type (in which one component forms fibrils within the other component). Composite fibers are preferable because of their low shrinkage in heat treatment. Binder fibers having a melting point of 100° to 130° C. are preferable because the formation and fabrication of shoes are usually performed at a comparatively low temperature except that injection molding for the integral insole is carried out at 150° C. The binder fibers in the web of face layer are not always necessary to be the same as those in the web of core layer. The binder fibers may preferably be treated for soilproofing, antistatic effect, flame resistance, and antibacterial finish. Such treatment may be carried out before or after the fibers are formed into the web.

The binder fibers may be composite fibers made up of a melting component and a non-melting component. Examples of their combination (melting/non-melting) are given below. Polyethylene/polypropylene, polyethylene/polyester, polyethylene/polyamide, polypropylene/polyester, polypropylene/polyamide, copolyester/polyester, copolyester/polyamide, copolyamide/polyester, and copolyamide/polyamide. The combination and ratio of the components should be properly selected according to the main fibers and heat treatment temperature. The fineness and length of the binder fibers do not affect the end product because they soften or melt during heat treatment. However, an adequate fineness is 2 to 20 d and an adequate length is 30 to 80 mm for the ease of carding in the preparation of web.

The main fibers and binder fibers are blended completely and the blend is formed into respective webs for the core and face layers by using a card or random webber, and the resulting webs are placed on top of the other. The two-layered web may be replaced by a single-layered web, in which case a special molding condition is established that produces the core layer and the face layer.

What is important in this invention is the mixing ratio of main fibers and binder fibers which greatly affects the properties of the final product. In order for the core web to exhibit stiffness and shape-keeping performance, it should be composed mainly of binder fibers, with the ratio of main fibers to binder fibers being 45/55 to 10/90. In the case where the binder fibers are composite fibers, the ratio of meltable component to non-meltable component is important and the latter component takes a part of the main fibers. In an extreme case, it is possible to produce the core web only with composite fibers used as binder fibers. On the other hand, the web forming the face layer is made mainly of main fibers because it is often required to have a soft, feltlike appearance. Thus the mixing ratio of main fibers to binder fibers should be 55/45 to 90/10, and preferably 65/35 to 80/20. If the ratio of binder fibers is increased, the resulting web will have a smooth surface even though the molding is achieved at a low temperature and under a low pressure. Binder fibers in an amount less than 10% do not provide the sufficient bonding of main fibers, with the result that the web of face layer is poor in abrasion resistance.

The typical shoemaking material of this invention is a laminate made up of a core layer, in which the ratio of main fibers to binder fibers is 45/55 to 10/90, and a face layer, in which the ratio of main fibers to binder fibers is 55/45 to 90/10.

The shoemaking material of this invention should have a weight of 200 to 1500 g/m$^2$. If the weight is lower than 200 g/m$^2$, the material is too thin to provide sufficient stiffness and shape keeping performance. The material having a weight in excess of 1500 g/m$^2$ is disadvantageous in weight saving and cost saving, although it is satisfactory in stiffness and shape keeping performance. The preferred weight is 400 to 800 g/m$^2$. In the shoemaking material having such a weight, it is desirable from the standpoint of stiffness and shape keeping that the core layer accounts for a greater portion than the face layer. The preferred core-to-surface weight ratio is 55/45 to 90/10.

According to this invention, the two webs of different kinds as mentioned above are laminated one over the other and the laminate is subjected to heat treatment under pressure or without pressure so that the binder fibers partly or entirely soften or melt. This heat treatment is performed equally for both webs of the laminate at a temperature lower than the melting point of the main fibers and higher than the softening point of the binder fibers. The heat treatment causes the binder fibers to soften or melt to bond the main fibers temporarily to one another. This in turn causes the web to shrink and to become compact. After this heat treatment, the laminate of webs undergoes the second heating and pressing steps.

In the second heating step, the temperature is within the range specified above but the front side and the back side of the laminate are treated at different temperatures. This is one of the most remarkable features of this invention. The second heating step is simultaneously accompanied by hot pressing or followed by cold pressing. This is the second feature of this invention.

As mentioned above, the process of this invention comprises the steps of heating the laminate of webs uniformly, heating the laminate at different temperatures for respective webs, and subjecting the heat-treated laminate to simultaneous hot pressing or subsequent cold pressing. Prior to the first heat treatment, the laminate of webs may be subjected to needle punching. Needle punching is effective particularly in the case where the laminate is of such a structure that a film or sheet is interposed between the two webs. In addition, where the laminate has a film interlayer, the heat treatment should be performed in such a way that both the bonding fibers and film soften or melt. This is effective in imparting stiffness. Interestingly, when made into an insole, the laminate having a film interlayer produced as mentioned above retains the absorbed sweat in the core layer, keeping the face layer dry.

In the case of the laminate having a film interlayer, it is necessary that the film be allowed to sufficiently shrink during the first heat treatment; otherwise, the laminate might be wrinkled during the second heat treatment due to film shrinkage. To minimize the shrinkage of the laminate, it is necessary to select a film having small shrinkage or to use composite fibers for the binder fibers.

The shoemaking material of this invention may be used for many parts of a shoe, for example, counter and cup insole, which are required to have stiffness and to keep a shape. Stiffness may be imparted by interposing a thermoplastic resin film between the two webs or by uniformly distributing a thermoplastic resin between the two webs. This is one of the modified embodiments of this invention. Interposition of a 50 to 300 μm thick film is preferable. A film thinner than 50 μm is not effective in improving the stiffness and a film thicker than 300 μm may damage needles during needle punching. A thermoplastic film may be replaced by a sheet of phenolic resin-impregnated kraft paper (basis weight: 100 to 200 g/m$^2$) in which the resin is previously crosslinked 50 to 80%. Such impregnated kraft paper permits needle punching to be performed easily, and the resin becomes 100% crosslinked during the second heat treatment, so that it imparts sufficient stiffness to the laminate.

The laminate which has undergone the first heat treatment for temporary bonding and shrinkage is then subjected to the second heat treatment in which the face and core webs are heated at different temperatures. The second heat treatment may be accompanied by simultaneous hot pressing or followed by subsequent cold pressing. The hot pressing forms a smooth surface on the laminate because the binder fibers in the molten or softened state are pressed against the main fibers. In hot pressing, the laminate should be demolded after mold cooling or after transfer to a cool mold of the same configuration, because it is easily deformed when it is hot. In a preferred embodiment, there is employed a mold with one side kept at a high temperature and the other side kept at a low temperature. The high-temperature side forms a smooth surface looking like plastics, and the low-temperature side forms a feltlike surface. Moreover, this mold permits easy demolding. To finish the core layer with a dense, smooth surface is important in the case where the laminate is used for making insoles by injection molding. In this case, the laminate is not heated again but is punched continuously into blanks for injection molding. During injection molding, the injected polyvinyl chloride oozes out of the insole unless the core layer of the insole has a dense surface. The dense, smooth surface can be advantageously formed by continuous pressing. That is, the laminate which has undergone the first heat treatment is pressed by hot rollers (core side temperature: 100° to 120° C.) and immediately thereafter pressed again by cold rollers. In the case of cold press method, the laminate is heated so that the binder fibers are sufficiently melted and then press-molded and cooled at the same time. This method permits the molded laminate to solidify soon and hence makes it possible to demold it immediately after pressing. This leads to improved productivity. Therefore, the cold press method is preferable in this invention. In the case of cold pressing, a feltlike surface is formed on the molded item if the mold temperature is lower than 50° C. and a dense smooth surface is formed if the mold temperature is higher than 50° C., especially higher than 70° C. A smooth surface which looks like plastics is formed only when the mold temperature exceeds 120° C. Such a surface imparts stiffness to the molding. The shoemaking material of this invention can be advantageously produced in a single molding cycle by using a mold having a mold temperature lower than 50° C. for the face and a mold temperature higher than 70° C. for the core layer, after the binder fibers have been melted. This temperature arrangement finishes the face layer feltlike and the core layer hard. In other words, the shoemaking material of this invention can be produced most advantageously by the cold pressing method. According to this method, a laminate of webs is heated uniformly in hot air and then heated again in such a way that the temperature for one side is different from the temperature for the other side, and finally the laminate undergoes cold pressing, with the temperature different for each side of the laminate.

As mentioned above, the present invention provides a shoemaking material in a simple manner which is a laminate capable of deep drawing, having the surfaces different in appearance from each other, the layers constituting the laminate being different in apparent density from each other. Moreover, It has superior functions such as (1) moisture permeability and quick drying, (2), cushioning properties and resilience, (3) moldability and shape keeping performance, (4) light weight, and (5) durability. The invention is now described in more detail with reference to the following examples.

EXAMPLE 1

The core web having a weight of 400 g/m$^2$ was produced from a 20/80 blend of hollow polyester fibers (12 d×51 mm) as the main fibers and polyethylene/polyester (70/30) matrix fiber (4 d×51 mm) as the binder fibers. The face web having a weight of 200 g/m$^2$ was produced from a 50/50 blend of dyed polyester fibers (5 d×51 mm) as the main fibers and polyethylene/polyester (70/30) matrix fibers (4 d×51 mm) as the binder fibers. The two webs discharged from two cards were laminated on a lattice, with a 50-μm thick polyethylene film interposed between them. The laminate underwent needle punching (50 needles/cm$^2$), with the face upward. The laminate underwent uniform heat treatment with hot air at 140° C. for 1 minute. The core side of the laminate was heated to 150° C. by infrared heating. Finally, the laminate underwent cold pressing with a deep-drawing mold which was kept at 70° C. for the core and 20° C. for the face. The pressing pressure was 0.4 kg/cm$^2$ and the pressing time was 30 seconds.

Thus there was obtained a molded insole superior in wear resistance and flexural resistance. It was made up of a face and a core, the former having feltlike resilience and the latter having stiffness sufficient to keep the shape. The, face had a thickness of 1.5 mm and an apparent density of 0.2g/cm$^3$ and the core had a thickness of 1.0 mm and an apparent density of 0.4 g/cm$^3$.

The insole produced as mentioned above is compared with commercial cup insoles as shown in Table 1. It is to be noted that the insole of this invention has an extremely high moisture-permeability. In actual service test, the face of the insole gave a dry feeling at all times.

TABLE 1

| | Commercial cup insoles | | |
|---|---|---|---|
| | Polyethylene sponge + rubber sponge + cloth | EVA copolymer** + rubber sponge + cloth | Product in Example 1 |
| Weight, g/m$^2$ | 1301 | 1198 | 658 |
| Thickness, mm | 4.84 | 5.86 | 2.50 |
| Apparent density, g/cm$^3$ | 0.269 | 0.204 | 0.371 |
| Water absorption, water content % | | | |
| after dipping for 1 hour* | 17.4 | 13.8 | 20.5 |
| after dipping for 4 hours | 17.2 | 26.8 | 38.3 |
| after dipping for 8 hours | 32.4 | 76.4 | 53.4 |
| after dipping for 24 hours | 52.3 | 50.7 | 67.3 |
| Water release, water content % | | | |
| after drying for 1 hour | 41.4 | 35.6 | 32.0 |
| after drying for 2 hours | 34.3 | 24.9 | 20.2 |
| after drying for 4 hours | 17.2 | 9.2 | 8.4 |
| after drying for 8 hours | 0 | 0 | 0 |
| after drying for 24 hours | 0 | 0 | 0 |
| Moisture permeability, 30° C., 80% RH, g/m$^2$/24 h | 55 | 107 | 3865 |
| Breathability, cc/cm$^2$/sec | 0.197 | 0.335 | 37.4 |

*At normal temperature
**Ethylene-vinyl acetate copolymer

EXAMPLE 2

The same laminate of webs as in Example 1 was prepared, except that the polyethylene film was replaced by a 100-μm thick one. After needle punching in the same way as in Example 1, the laminate was uniformly heated by hot air at 140° C. for 1 minute. The laminate was cut in size, and the cut piece was sewed onto the outer leather, with the core side of the laminate in contact with the back side of the leather. The face of the laminate was heated to 160° C. by infrared heating. During this heating, the leather remained intact although its surface temperature reached 130° C. After heating, cold press molding was carried out under a pressure of 1 kg/cm$^2$ for 1 minute.

Thus there was obtained an integrally molded item (counter) superior in rebound, resilience, stiffness, and shape keeping. It is to be noted that the laminate can be sewn in the flat state prior to molding and the leather was not damaged during the heating and molding steps. The face had a thickness of 1.3 mm and an apparent density of 0.35 g/cm$^3$; and the core had a thickness of 1.0 mm and an apparent density of 0.9 g/cm$^3$. The face of the counter produced in this example had the same feltlike feeling and appearance as were obtained by surfacing a non-woven fabric in the conventional technology. In addition, the core of the counter had stiffness sufficient to keep the shape and reboun and flexibility sufficient to recover the shape after flexure.

EXAMPLE 3

The core web having a weight of 400 g/m$^2$ was produced from a 20/80 blend of hollow polyester fibers (12 d×51 mm) as the main fibers and polypropylene/polyester (70/30) matrix fiber (4 d×51 mm) as the binder fibers. The surface web having a weight of 200 g/m$^2$ was produced from a 80/20 blend of dyed polyester fibers (5 d×76 mm) as the main fibers and polypropylene/polyester (70/30) matrix fibers (4 d×51 mm) as the binder fibers. The two webs were laminated with a 200-μm thick polypropylene film interposed between them. The laminate underwent needle punching and then uniform heat treatment with hot air at 170° C. for 1 minute. While still hot, the laminate was passed through two pairs of hot press rollers with a roller gap of 2.5 mm. The temperature for the core was 100° C. and the temperature for the face was 50° C. After that the laminate was passed through two pairs of cooling rollers with a roller gap of 2.5 mm. The cooling rollers were kept at 20° C. for both the core and the face. The flat sheet thus produced was made up of a core layer having a thickness of 1 mm and an apparent density of 1.0 g/cm$^3$ and a face layer having a thickness of 1.5 mm and an apparent density of 0.3 g/cm$^3$. The core layer had a stiff, smooth surface which looks like plastics, and the face layer had a feltlike resilient surface. The pressed flat sheet was punched and the resulting blank was used as an insole. The insole was sewn onto the upper of a shoe and then injection molding of polyvinyl chloride resin was performed (150° C., 6 kg/cm$^2$) under the lower side or the core layer. Oozing of polyvinyl chloride from the upper side of the insole was not observed. The insole was found to have proper resilience and pilling resistance.

What is claimed is:

1. A shoemaking material, which comprises:

a laminate comprised of at least two webs, each of said webs being formed by bonding main fibers with binder fibers, said binder fibers being at least partly softened or melted, wherein a first web has a density lower than about 0.4 g/cm$^3$ and a ratio of main fibers to binder fibers of 55:45 to 90:10 and a second webb has a density higher than about 0.3 g cm$^3$ and a ratio of main fibers to binder fibers of 45:55 to 10:90, the difference between said densities being greater than above 0.1 g/m$^3$, and wherein weight of said laminate is from about 200 to 1500 g/cm$^3$.

2. A shoemaking material as set forth in claim 1, wherein the difference between the two densities is greater than 0.3 g/cm$^3$.

3. A shoemaking material as set forth in claim 1, wherein said a second web has a density greater than 0.7 g/cm$^3$.

4. A shoemaking material as seto forth in claim 3, wherein the density of said second web is 0.9 to 1.3 g/cm$^3$.

5. A shoemaking material as set forth in claim 1 wherein,the first web has an apparent density lower than 0.4 g/cm$^3$ and the second web has an apparent density higher than 0.3 g/cm$^3$, said laminate further comprising a third web, paper, woven or knitted fabric, or film interposed between the first and second webs.

6. A process for producing the shoemaking material of claim 1 which comprises forming said first web from a blend of main fibers and binder fibers having a lower melting point that that of the main fibers, the blend ratio being 55:45 to 90:10 by weight forming a second web from a blend of main fibers and binder fibers having a lower melting point than that of the main fibers, the blend ratio being 45:55 to 10:90 by weight, laminating the two webs to form a laminate having a weight of 200 to 1500 g/m$^2$; heating the laminate uniformly at a temperature higher than the melting point of the binder fibers and lower than the melting point of the main fibers; thereafter heating the two major surfaces in such a manner that the temperature for one said surface is higher than that for said second surface wherein the temperatures are within the range as specified for said first heating step; and wherein said second heating step is simultaneously accompanied by not pressing or followed by cold-pressing the laminate at a temperature lower than either heat treatment temperature.

7. A process for producing a shoemaking material as set forth in claim 1, wherein said the mold temperature during cold pressing is kept at 70° C. or above for the side of said first web and at 50° C. or below for the side of said second web.

8. A process for producing the shoemaking material of claim 1 which comprises forming said first web from a blend of main fibers and binder fibers having a lower melting point than that of the main fibers, the blend ratio being 55:45 to 90:10 by weight; forming said second web from a blend of main fibers and binder fibers having a lower melting point than that of the main fibers, the blend ratio being 45:55 to 10:90 by weight; laminating the two webs to form a laminate having a weight of 200 to 1500 g/m$^2$; heating the laminate uniformly at a temperature higher than the melting point of the binder fibers and lower than the melting point of the main fibers; and heating the surface of the laminate under no pressure in such a manner that the temperature for said first web is higher than that of said second web wherein the temperatures are within the range as specified above.

* * * * *